United States Patent [19]

Harada et al.

[11] 4,056,428

[45] Nov. 1, 1977

[54] PROCESS FOR ETCHING INNER SURFACE OF PIPE OR TUBE

[75] Inventors: Nobuhiko Harada; Minetaka Tanaka; Masanao Shimano; Kyozo Fujinaga; Kunito Nunomura; Masamitu Tamura; Shigeharu Nakamura; Kazuo Akagi, all of Shimonoseki, Japan

[73] Assignee: Kobe Steel, Ltd., Kobe, Japan

[21] Appl. No.: 620,230

[22] Filed: Oct. 6, 1975

[30] Foreign Application Priority Data

Oct. 5, 1974 Japan ..... 49-114874

[51] Int. Cl.[2] ..... C23F 1/00

[52] U.S. Cl. ..... 156/642; 156/345; 156/664

[58] Field of Search ..... 156/2, 7, 16, 18, 345, 156/642, 654, 664; 134/101-103, 108, 152, 166, 171, 8, 22-24, 26-30

[56] References Cited

U.S. PATENT DOCUMENTS 2,935,429 5/1960 Grotlisch ..... 134/22

3,673,042 6/1972 Mayers ..... 156/25 X 3,751,313 8/1973 Benedetto et al. ..... 156/16

*Primary Examiner*—William A. Powell

*Attorney, Agent, or Firm*—Oblon, Fisher, Spivak, McClelland & Maier

[57] ABSTRACT

An apparatus and process for etching the inner surface of a pipe or tubular member includes a primary pipe adapted to be connected with a pipe or pipes whose inner surfaces are to be treated, and treating-solution supply pipes communicating, by means of electromagnetic valves, with the aforenoted primary pipe, whereby one path for a specific solution to be fed through one of the treating-solution supply pipes by means of the primary pipe into the pipe to be treated is automatically switched to another path by means of the aforenoted electromagnetic valves, without causing mixing of one solution with another. This apparatus and process therefore provides improved operational efficiency as well as a uniform surface condition and achieves accurate dimensioning for the inner surface of the pipe to be treated.

6 Claims, 11 Drawing Figures

PROCESS FOR ETCHING INNER SURFACE OF PIPE OR TUBE

BACKGROUND OF THE INVENTION

1. Field of the Invention

The present invention relates generally to an apparatus and process for use in etching the inner surface of a pipe or tubular member, and more particularly to an apparatus and process which facilitates the automatic etching process of the inner surface of the pipe or tubular member.

2. Description of the Prior Art:

Etching processes for the inner surfaces of various kinds of metal pipes, including stainless steel pipes, are of course known, however, some of the pipes have to be subjected to the strict requirement that the pipes be singly subjected to the ectching treatment. With stainless steel pipes, in general, a plurality of pipes may be dipped within an acid solution at a single time for the etching of both the inner and outer surfaces of the pipes, however, pipes of zironium or a zirconium alloy, or pipes of titanium or a titanium alloy, which are required to have smooth surface conditions, pose difficulties within a such a dipping type etching process.

The pipe is normally produced by subjecting only its outer surface to a polishing operation subsequent to the final annealing step, and subsequently thereafter, the pipe is subjected to etching upon its inner and outer surfaces so as to thereby provide mirror-finish surfaces for the inner and outer surfaces thereof. In this case, portions of the pipe, upon which the etching acid solution dwells or remains relatively stationary, causes pits, which are non-uniform portions upon its resulting surface, and as a result, etching of a plurality of pipes at a single time is impossible.

In the instance that the pipes should be subjected to etching using two types of acids, such as for example, a concentrated and a weak acid, each step of the etching process has to be precisely controlled such as, for example, the process should include weak acid treatment (90 seconds) → concentrated acid treatment (30 seconds) → neutralizing liquid treatment (10 seconds) and water rinsing, and these steps should also be conducted continuously. Even in the instance of using a medium strength acid, steps similar to those noted hereinabove should be followed. In the event of a discrepancy in the treatment, white corrosions will occur upon the surface of the pipe during the final autoclave step. Still further, the pipes must also be finished as closely as possible to cope with tests which will be conducted by the consumer. For this reason, the pipes should be dipped within the acid solution in a single or individual and independent manner, because of the strict requirements of quality.

FIG. 1 shows on type of prior art apparatus for use in etching a pipe or tubular member, such as for example, a pipe made of, for example, zirconium alloy, for which strict requirements are set forth. As shown, a weak acid tank 21, a concentrated acid tank 22, a neutralizing tank 23, and a water rinsing tank 24 are arranged in parallel fashion. Initially, a single pipe 25 is placed upon or within triangular balance jigs 26, and subsequently, the balance jigs and pipe are placed within the weak acid tank 21 by means of two operators *a* and *b* in response to a signal of an operator *e* who monitors the dipping time. The pipe is then rotated slowly and swung. Upon completion of the pickling within the weak acid tank for a desired period of time, the operators *a* and *b* in response to another signal of the operator *e* remove the pipe from the tank 21 and then immediately place the pipe within the concentrated acid tank 22. Operators *c* and *d* dip the pipe therein and rotate and swing the same for a predetermined period of time in a manner similar to that of the preceding step.

Upon completion of the concentrated acid etching, according to another signal of the operator *e,* the operators *c* and *d* immediately place the pipe within the neutralizing tank 23, so as to allow the neutralizing liquid to enter the pipe, and subsequently, the pipe is removed therefrom and placed within the water rinsing tank 24 for the water rinsing operation. At this time, the pipe 25 is placed upon a spacer support 27. The etching step thus governs the quality of the product, and therefore, if the time duration of the concentrated acid treatment and the neutralizing treatment is excessive, then there results a non-uniform surface, or the creation of spots upon the surface of the pipe. As a result of the foregoing, it is seen that there is required four operators, *a, b, c* and *d,* in addition to the operator *e* for monitoring the dipping time and the dimensions of the pipe, bound to mere manual operations which results in poor operational efficiency.

In addition, the aforesaid prior art process suffers from further disadvantages in that the ratio of the thickness reduction of the outer surface of the pipe to that of the inner surface is 1:2, presenting a considerable difference in thickness reduction due to the etching of an acid. Still further, the inner portions of the opposite, open ends of the pipe are subjected to a considerable etching or thickness reduction, while the intermediate inner surface of the pipe presents a non-uniform thickness-reduction.

Still yet further, an excessively large amount of weak and concentrated acids and neutralizing liquid are required for performance of the conventional etching process for a pipe, and this in turn, results in a large amount of deteriorated acid or liquid which must be replaced. In addition, the use of nitric acid, hydrofluoric acid and the like presents safety problems for the operators, because of an acid-vapor atmosphere and splashing of the acids upon the operators, the use of concentrated acid being quite dangerous. Such safety problems are equally or even preferentially important, as compared with the need for a uniform etching treatment of pipes.

Description has been given thus far of etching pipes made of for example, zirconium or zirconium alloy. However, where pipes should be individually or singly subjected to the etching process, procedures similar to those shown within FIG. 1 are required, and this entails the use of a single type of acid, that is, a medium type acid. As an alternative, there has been proposed an attempt within which there is provided a single rotary rocking shaft having a pair of disc type spacers at the opposite ends thereof, while several pipes are mounted upon the spacers in parallel relation to the shaft, whereby the pipes are rotated and swung within a treating tank for a predetermined period of time. This however results in non-uniform thickness reduction due to the action of the acid, as well as an increase in the treatment time, during which period, the pipe is transferred from the concentrated acid tank to the neutralizing tank, thus leading to non-uniform surface conditions of the pipe.

SUMMARY OF THE INVENTION

Accordingly, it is an object of the present invention to provide an apparatus and process for etching the inner surface of a pipe, within which a series of steps of weak acid and concentrated acid treatmenst, a neutralizing step and a water rinsing step are carried out in an efficient and continuous manner.

Another object of the present invention is to provide an apparatus and process for etching the inner surface of a pipe which leads to a considerable saving in man hours, as well as the amount of treating solutions used.

A further object of the present invention is to provide an apparatus and process for use in etching the inner surface of a pipe, which facilitates the control of thickness-reduction of the pipe due to the etching thereof by an acid.

A still further object of the present invention is to provide an apparatus and process for use in etching the inner surface of a pipe, which presents safe operational conditions.

The foregoing and other objects are achieved according to the present invention by the provision of an apparatus and process for etching the inner surface of a pipe, which includes supporting the pipe or pipes upon a support means, a primary pipe adapted to fit the entrance ends of the pipe or pipes, treating-solution supply pipes operatively connected with solution tanks which contain treating solutions therein, electromagnetic valves interposed between the primary pipe and the treating-solution supply pipes, and solution receiving means located at the exit ends of the pipes and adapted to receive solutions from the exit ends of the pipes for thereby recovering the solutions:

Switching means for automatically switching the electromagnetic valves interposed between the primary pipe and the treating-solution supply pipes, and flow-rate regulating valves are also provided, and a mechanism which may shift the solution-receiving means to a particular position for receiving a solution, as well as re-cycling means for returning the solution thus received to a supply tank containing the solution, is likewise included. Still yet further, an air supply pipe, through which air is introduced into the primary pipe, is also included, the primary pipe having at least one outlet of an inner diameter which is the same as the inner diameter of the pipe being treated. Timer means for controlling the flow of the solutions through the pipe for a predetermined period of time are further provided.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 2:
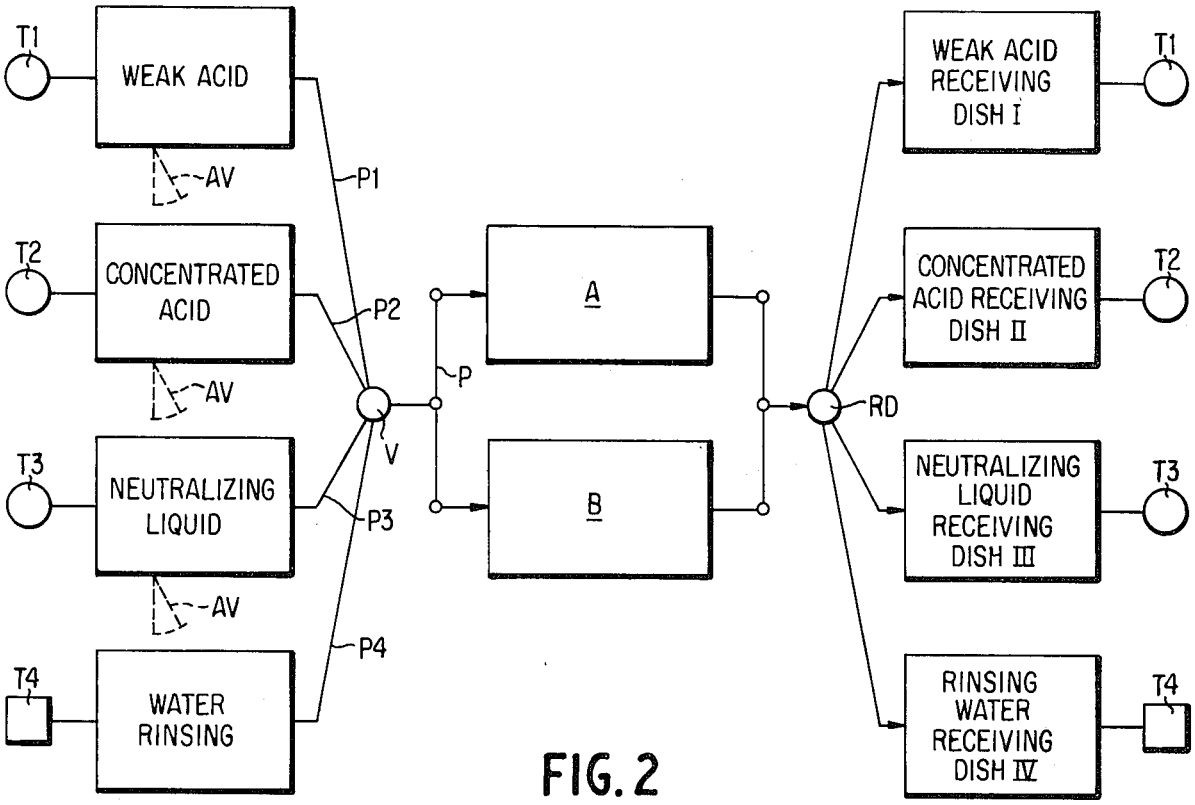
FIG. 2 is a schematic, sequential diagram of the apparatus and process developed in accordance with the present invention.
Figure 5:
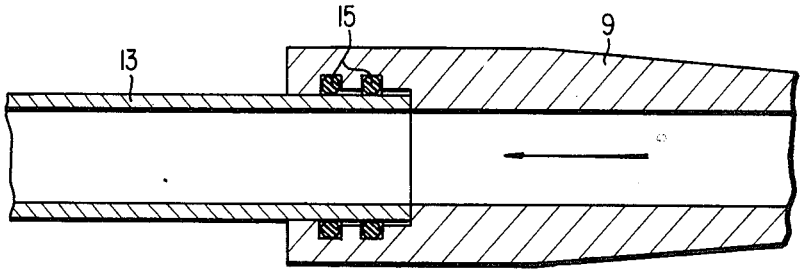
FIG. 5 is a longitudinal cross-sectional view showing the essential portion of a cap or adapter connected with the entrance end of a pipe.

The apparatus and process developed in accordance with the present invention will now be described in conjunction with the accompanying drawings, within which, for example, a pipe made of for example zirconium or zirconium alloy is subjected to an etching process which includes the sequential steps of etching the same with weak and concentrated acids, immersing the same within a neutralizing treatment, and subjecting the pipe to water rinsing steps. FIG. 2 is a schematic outline of the serial sequence of the operations of the automatic etching process to be performed upon the inner surface of the pipe utilizing the apparatus of the present invention, pipes to be treated being designated at A and B.

According to the apparatus and process of the present invention, four types of solutions, that is weak acid, concentrated acid, neturalizing liquid, and water, flow through the pipes for given periods of duration. respectively, without causing mixing of one type of solution or liquid with another, and the flows of the respective solutions are adapted to be switched from one path or conduit to another. To this end, there is provided an electromagnetic valve V which interconnects a primary flow path P and solution supply pipes P1, P2, P3, P4, the primary flow path P being in communication with the entrance ports of the pipes A and B while the solution supply pipes P1, P2, P3 and P4 are in turn, respectively connected to a weak acid reservoir T1, a concentrated acid reservoir T2, a neutralizing liquid reservoir T3, and water source T4. Thus, the electromagnetic valve V is interposed between the primary path P and the respective solution supply pipes P1, P2, P3, and P4 so as to facilitate switching and controlling the respective flow paths for the solutions leading from such supply pipes and to the main path P, whereby the etching process with the weak or concentrated acids, the neutralizing treatment, and water rinsing steps may be carried out sequentially with respect to the inner surfaces of the pipes A and B.

The solutions flowing out of the pipes A and B are received within a rotary solution receiving means or disk RD which in turn leads to a weak acid receiving dish I, a concentrated acid receiving dish II, a neturalizing liquid receiving dish III, and a rinsing water receiving dish IV, each of the latter dishes leading, respectively, to the reservoirs T1, T2, and T3, the water not being re-used but in fact, discharged through means of auxiliary reservoir or tank T4. The time of passage of a particular treating solution through the pipes may be predetermined depending upon the desired thickness reduction due to etching, and consequently, the time may be controlled by means of a timer.

Still referring to FIG. 2, the electromagnetic valve V for controlling the solution supply pipe P1 and the supply of the weak acid therethrough may be opened for a given period of time by means of a switch and timer mechanism, and consequently, a weak acid flows through the main path P and into the pipes A and B, respectively, for pickling the same due to the action of the weak acid for the predetermined period of time. In this respect, the flow rate of the solution through the pipes A and B may be closely adjusted by means of manual cocks which are located within the vicinity close to the entrance ports of the pipes A and B. The weak acid which has passed through pipes A and B is, of course, then received within the rotary solution receiving dish RD and then received in turn within the weak acid dish I so as to be returned to the reservoir T1. Upon completion of the supply of the weak acid to the pipes A and B, the weak acid remaining within the amain pipe P is then purged by means of pressurized air fed through means of an air valve AV and into the receiving dish RD.

After the used weak acid has been recovered within the weak-acid receiving dish I, the rotary dish RD is rotated so as to bring its outlet port into registry with the inlet port of the concentrated dish II. Subsequently, the electromagnetic valve V for the solution supply pipe P2 for the concnetrated acid is opened by means of a timer mechanism so as to allow the concentrated acid to flow through the main pipe P and into pipes A and B for a predetermined period of time, the used concentrated acid being discharged from the exit ports of pipes A and B and recovered within the concentrated acid receiving dish II. Upon completion of the etching process with the concentrated acid, the residual concentrated acid remaining within the pipe may be discharged by means of pressurized air supplied through means of the air valve AV, followed by the rotational shifting of the rotary dish RD into registry with the neturalizing liquid receiving dish III and the introduction of the neturalizing liquid, through means of the solution supply pipe P3 and the electromagnetic valve V, into pipes A and B for a predetermined duration of time. Lastly, the water rinsing step is performed in a manner similar thereto. As is thus clear from the schematic sequential diagram or flow chart within FIG. 2, supply of the solutions into the pipes A and B may be carried out continuously and automatically by means of the elctromagnetic valve, and consequently, a single operator may monitor such an etching process for the inner surface of a pipe.

Figure 3:
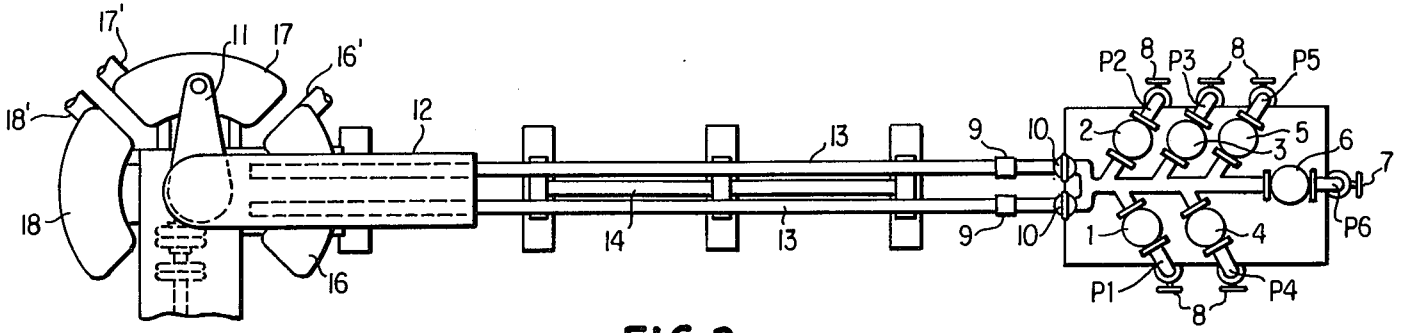
FIG. 3 is a plan view of one embodiment of the apparatus of the present invention, showing its cooperative parts.
Figure 4:
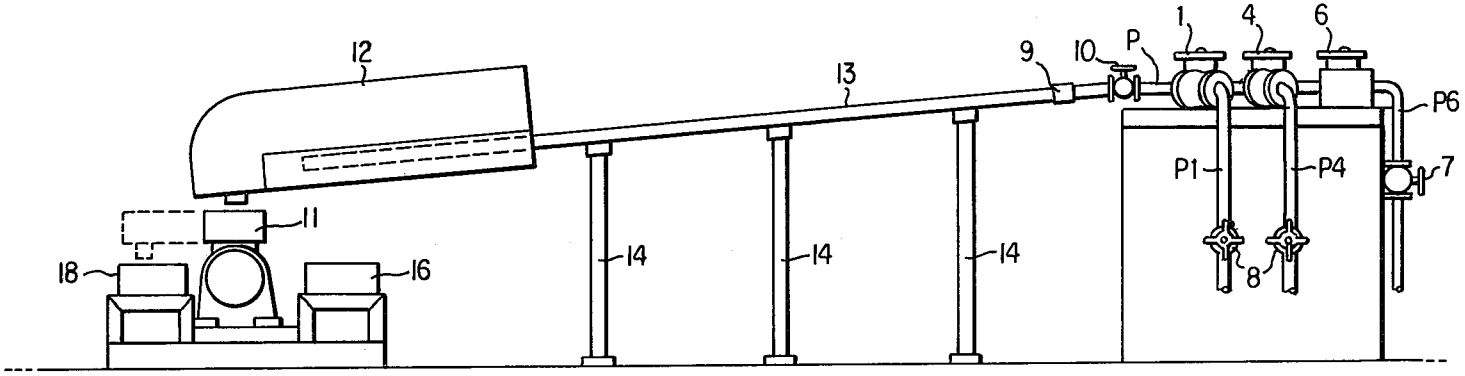
FIG. 4 is a side elevation view of the apparatus of FIG. 3.
Figure 7A:
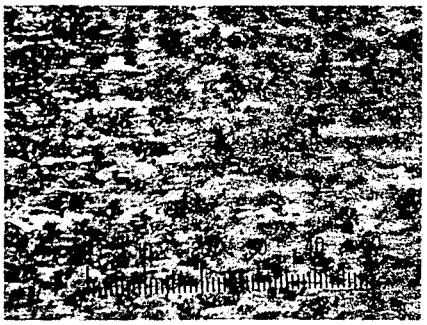
FIGS. 7A – 7D are photographs comparing the surface conditions of the inner surfaces of pipes, which have been subjected to etching according to the present invention, with that of pipes which have been subjected to etching according to prior art apparatus and processes.
Figure 7B:
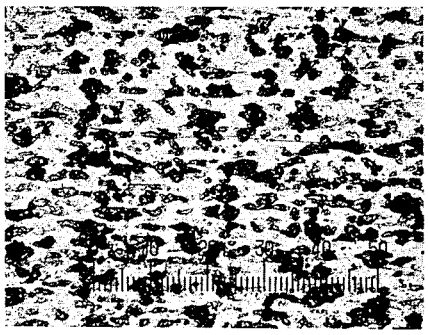
Figure 7C:
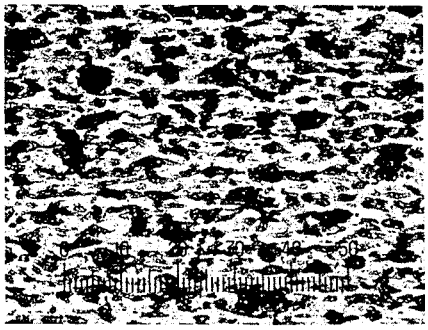
Figure 7D:
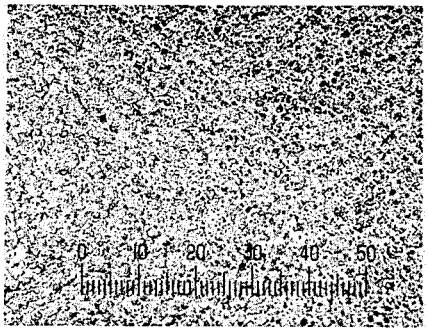

Referring to FIGS. 3 and 4, there is shown one of the embodiments of the apparatus constructed in accordance with the present invention, by which the process of the present invention may be practiced. Pipes 13 are mounted upon supports 14 so as to be inclined downwardly in the downstream direction, and are connected at one end thereof with fluid ports provided upon opposite sides of the longitudinal axis of the primary pipe P, balance cocks 10 being additionally provided in operative association with the primary pipe P at positions immediately downstream of the aforenoted ports. Fluidically connected to the primary pipe P are a weak acid supply pipe P1 having an electromagnetic valve 1, a concentrated acid supply pipe P2 having an electromagnetic valve 2, a neutralizing liquid supply pipe P3 having an electromagnetic valve 3, and a rinsing water supply pipe P4 having an electromagnetic valve 4, communication between the liquid supply pipes P1, P2, P3 and P4 with the primary pipe P therefore being capable of being interrupted or provided by means of the aforenoted electromagnetic valves 1, 2, 3 and 4. Further connected to the front end of the primary pipe P is an air supply pipe P6 having an electromagnetic air valve 6 operatively associated therewith, and an auxiliary supply pipe P5 having an auxiliary electromagnetic valve 5 is also provided. A manual regulating cock 7 is provided for use with the air supply pipe P6, and a manual cock 8 is simiarly provided upon each of the solution supply pipes P1 – P5. The pipes P1 – P3 are in communication with a weak acid reservoir, a concentrated acid reservoir, and a neutralizing liquid resevoir, respectively, by means of suitable pumps, not shown, while the pipe P4 for the rinsing water is connected to a suitable water source, not shown.

Positioned at the exit ends of the pipes 13 is a used-solution receiving, rotary dish 11 which receives the used solutions from the pipes, after which the solutions are discharged into a weak acid receiving dish 16, a concentrated acid receiving dish 17 and a neturalizing liquid receiving dish 18, respectively. The solutions are ultimately returned to the respective reservoirs from the respective receiving dishes 16, 17, and 18 by means of outlet conduits 16', 17' and 18' and the pumps, not shown, however, the rinsing water may be externally discharged as an effluent. A safety cover 12 for preventing splashing of the concentrated acid is also provided above the discharge ends of the pipes 13.

Figure 6I:
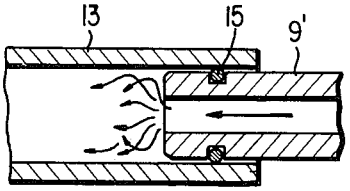
FIGS. 6 (I) and 6 (II) are views similar to that of FIG. 5, illustrative however of other adapters.
Figure 6:
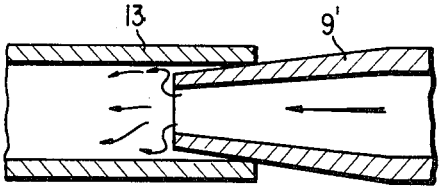

Still referring to FIGS. 3 – 6, the pipes 13 are provided with connector caps or adaptors 9 and the connection of the pipes 13 with the caps or adaptors 9 should be such that when a solution is introduced, by means of the primary pipe P, the pumps and the like, into the pipes 13, there should be no flow resistance at the junction thereof nor a change in the flow velocity. To this end, the pipe is provided with caps as shown, for example, within FIG. 5 as seen therein, the cap 9 is adapted to fit upon the end of the pipe 13, and the inside diameter of the cap 9 is the same as that of the pipe 13. To the contrary, in case a cap 9', as shown within FIGS. 6(I) and 6(II) is used, turbulence occurs at the junction of the cap 9' and the pipe 13 along the inner surface of the pipe, resulting in a variation of the effective wall thickness of the pipe 13. O-rings 15 insure the sealing integrity of the system.

Figure 1:
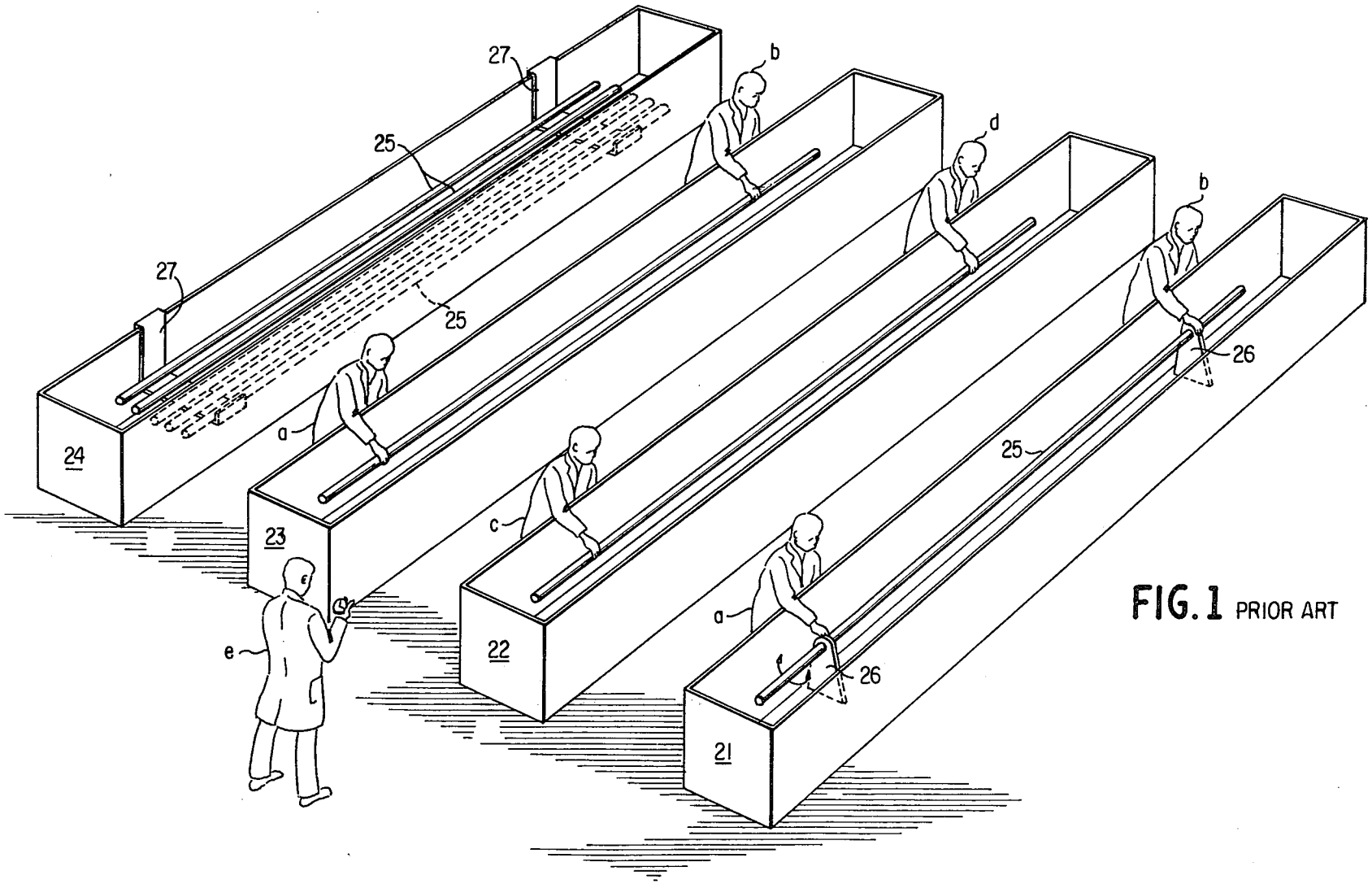
FIG. 1 PRIOR ART
FIG. 1 is a schematic, perspective view illustrative of the prior art apparatus for use in etching the inner surface of a pipe.

As is clear from the description of the operative sequence of FIG. 2, and the embodiments shown within FIGS. 3 and 4, etching of the inner surface of a pipe may be efficiently carried out with a resulting uniform quality of products, by utilizing the process and apparatus of the present invention. Within the illustrated embodiments, two pipes 13 have been disclosed as being able to be treated at the same time, however, the present invention should by no means be limited to this instance, for the number of pipes being treated at a particular time may be increased as desired, presenting an even more efficient operation or etching process, in contrast to the prior art apparatus as shown for example within FIG. 1.

In accordance with the present invention, an operator is simply required to place the pipes 13 upon supports 14 and to connect the pipes 13 to the caps 9 of the primary pipe P. The succeeding steps of the process will be readily accomplished by means of the electromagnetic valves 1, 2 3, 4, and 6 due to their automatic switching of the flow paths, according to timers which have been preset by the operator. This achieves the sequential steps of the etching process for the inner surfaces of the pipes 13, the process including the use of the weak acid, the concentrated acid, the neutralizing liquid, and the rinsing water, all of which may be fed into the pipes for predetermined periods of time, respectively, thereby enabling the automatic processing of pipes under consistent and constant conditions so as to thereby provide high quality products. Furthermore, there may be achieved ready control for the thickness reduction of the pipes due to the etching process while the amounts of the solutions employed within the apparatus according to the present invention may be equal to ½ - 5/6 of the amount of such solutions which are normally required for the dipping type apparatus and process of the prior art, thereby achieving a materials saving a ½ - 1/6, or approximately 16 - 50%. In addition, deterioration of the solutions may be suppressed.

According to the prior art etching apparatus and process of the dipping type, hydrogen gas, which is generated at the time of the etching, remains upon the inner surfaces of the pipes therein thereby presenting and causing the formation of pits. In contrast thereto, according to the apparatus and process of the present invention, hydrogen gas may be discharged along with a treating solution, externally of the pipes since the treating solution is maintained in a flowing state thus preventing the formation of pits upon the inner surfaces of the pipes. Even in the instance that a nitric acid solution and a hydroflouoric acid solution are utilized as the acids within the etching process for a pipe made of zirconium or zirconium alloy, there is no possibility of the acids splashing onto an operator or the vapors thereof being breathed by the operators, thus presenting additional improvements in safety and operational conditions.

The difference in quality between a pipe made of for example, a zirconium alloy which has been subjected to etching upon its inner surface, and that which has been subjected to etching according to the prior art, is quite distinct. FIG. 7, for example, shows microscopic views of the inner surfaces of the pipes.

The mirror-finish surfaces may in fact be achieved for the inner surfaces of the pipes in accordance with the process of the present invention as well as that of the prior art, although distinct differences may be visually noted. FIG. 7 shows microscopic views of the inner surfaces of the pipes at a magnification of 100X, the surface condition of a pipe as rolled and annealed being shown at (A), that of a pipe subjected to the etching process according to the prior art apparatus shown in FIG. 1, being shown at (B), that of a pipe which has been moved within an acid in the axial direction according to the dipping type etching process, being shown in (C), and that of a pipe subjected to the etching process according to the present invention being shown at (D). It is apparent that the surface condition (D) is superior to those of (B) and (C).

It should be construed that the aforenoted embodiments of the present invention are provided merely for illustrative purposes. If the entire construction of the apparatus is made of a metal having high heat-resistance, then the temperatures of the solutions may be increased for the application to the horning process for stainless steel pipes. In addition, the apparatus and process according to the present invention may be applied to etching of the inner surfaces of any type of metal pipe, and are particularly well adapted for use in the surface treatment of the same to a mirror-surface finish and in the removal of defects from the inner surfaces of the pipes. Still further, the apparatus and process according to the present invention allows mass production of pipes which are to be subjected to etching upon their inner surfaces, as well as the automatic processing of pipes.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by letters patent of the United States is:

1. A process for etching the inner surface of a pipe or tube by using a plurality of treating solutions, comprising the steps of:

connecting one end of said pipe or tube to an outlet of a treating solution supply means, in a solution-tight sealing manner, having switching means therein for switching and providing a respective treating solution;

supplying and switching said respective treating solutions including a weak acid solution and a concentrated acid solution in turn so as to conduct each treating solution through the pipe or tube for a predetermined period of time;

independently receiving said respective treating solutions flowing out of the other end of the pipe or tube; and supplying air into said pipe or tube, upon completion of the respective supply of said treating solutions, for discharging residual portions of said treating solutions disposed within said pipe or tube.

2. A process as defined within claim 1, wherein:

said received treating solutions are respectively returned to respective solution reservoirs and recycled to said pipe or tube.

3. A process as defined within claim 1, wherein:

the flow rate of said treating solution flowing within said pipe or tube is regulated.

4. A process as defined within claim 1, wherein:

the step of switching of said treating solutions is automatically accomplished without causing mixing of one of said treating solutions with another.

5. A process as defined within claim 1, wherein:

the supplying step includes a timing step so as to control the flow of said treating solutions for a predetermined period of time.

6. A process as defined within claim 1, wherein said process further comprises the step of shifting of receiving dishes to accomplish said independent receiving of said treating solutions.

* * * * *